United States Patent [19]

Piacenza

[11] Patent Number: 4,952,112

[45] Date of Patent: Aug. 28, 1990

[54] MECHANICAL-STORAGE MULTI-LEVEL CARPARK

[76] Inventor: Giorgio Piacenza, Via Oberdan, 8, 26100 Cremona, Italy

[21] Appl. No.: 317,683

[22] Filed: Mar. 1, 1989

[51] Int. Cl.[5] ..... E04H 6/16

[52] U.S. Cl. ..... 414/251; 414/250; 272/43; 52/30; 52/174

[58] Field of Search ..... 414/233, 242, 249, 250, 414/251; 272/39, 43, 44, 45; 52/29, 30, 31, 174, 175; 446/423; D21/248, 249; 198/800

[56] References Cited

U.S. PATENT DOCUMENTS

| | | | |
|---|---|---|---|
| 2,738,885 | 3/1956 | Demaline | 414/250 |
| 2,838,187 | 6/1958 | Schulte | 414/249 |
| 2,847,720 | 8/1958 | Hamm | 52/174 X |
| 2,945,603 | 7/1960 | McGuinness | 414/250 |
| 2,955,718 | 10/1960 | Messick | 414/251 |
| 3,269,569 | 8/1966 | Brauner | 414/250 |
| 3,356,233 | 12/1967 | DeFilippis | 414/250 |
| 3,547,281 | 12/1970 | Lichti | 414/251 |
| 3,887,089 | 6/1975 | Francis | 414/251 |

FOREIGN PATENT DOCUMENTS

| | | | |
|---|---|---|---|
| 0917597 | 7/1954 | Fed. Rep. of Germany | 446/423 |
| 3414839 | 8/1985 | Fed. Rep. of Germany | 414/250 |
| 0967889 | 10/1982 | U.S.S.R. | 414/239 |

*Primary Examiner*—Robert J. Spar
*Assistant Examiner*—John VandenBosche
*Attorney, Agent, or Firm*—Roylance, Abrams, Berdo & Goodman

[57] ABSTRACT

A mechanical-storage multi-level carpark includes a gantry structure formed by a set of uprights and cross-beams, defining a space inside which a vertical carrousel structure is supported, which is provided with car housing support.

20 Claims, 4 Drawing Sheets

MECHANICAL-STORAGE MULTI-LEVEL CARPARK

The present invention relates to a mechanical-storage multi-level carpark.

The continuous increase in the number of vehicles in the high-population-density centres has worsened the problem of their garaging to such an extent, that it has already been thought for some time to carry out the storage of said vehicles by means of mechanical means inside multi-level carparks. Such multi-level carparks are structured as warehouses, and hence it is not possible for the vehicles to enter them, and leave them by only using their own locomotion means, contrarily to what commonly happens in the brickwork multi-storey carparks, built at a still earlier time, wherein slopes to be used both during the exiting and entering steps allow each vehicle to travel through the various stories, so to be able to reach or leave the assigned parking area.

The mechanical-storage multi-storey carparks, on the contrary, comprise a set of adjacent rows of closed-structure, or open-structure, cells, superimposed upon one another, so to constitute a plurality of levels served by one single mechanical means (usually a tram crane) used for the operations of vehicle loading and unloading.

Such mechanical-storage multi-level carparks, although achieve the purpose they were conceived for, i.e., to be able to store, relatively to the occupied room, a much higher number of vehicles, than the brickwork multi-storey carparks, show drawbacks, which are hereunder listed:

long waiting times for the recovery and the garaging of the car.

so high installation and operation costs, as to only justify the public use thereof, obviously barring their use to small communities, such as, e.g., the condominiums.

impossibility of recovering or garaging the car in emergency situations, in particular in case of electrical energy supply blackout or breakdown of the mechanical means (the tram crane) which handle the cars inside the carpark.

The purpose of the present invention consists in providing a mechanical-storage multi-level carpark capable of obviating the above-said drawbacks, and which:

makes it possible to considerably reduce the waiting times due to the steps of recovery or of garaging of the cars, is cheap, because it has a simple and modular structure, making it possible to construct both large multi-level carparks for public use, and small multi-level carparks for use by small communities, and, in both cases, the operation costs are particularly low, in as much as the attendance by people skilled in the control of the mechanical means handling the vehicles is not necessary, is provided with loading and unloading means which can be driven by means of so reduced powers, that the manual drive thereof is reasonably possible in case emergency conditions occur.

Such purposes are achieved by means of mechanical-storage multi-level carpark characterized in that it comprises a first structure integral with the ground and supporting, rotatable around a horizontal axis, a second structure, of carrousel type, equipped with means for garaging the vehicles, and moved, to allow the loading and unloading thereof, by driving means.

The invention is illustrated for exemplifying only, not limitative, purposes, in the Figures of the hereto attached drawing tables.

Figure 1:
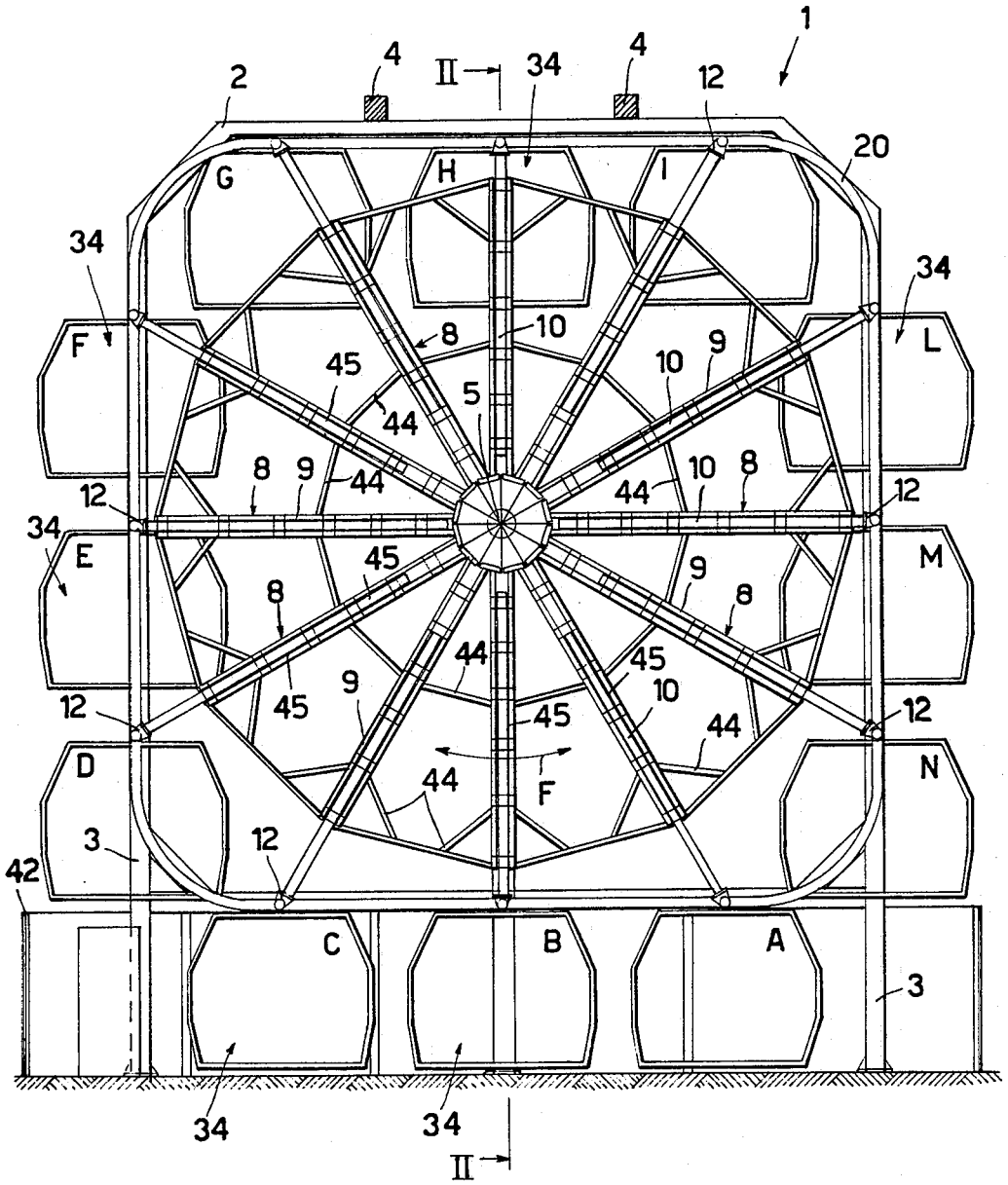
FIG. 1 is a sectional view of the multi-level carpark of the invention, according to line I—I of FIG. 2.
Figure 2:
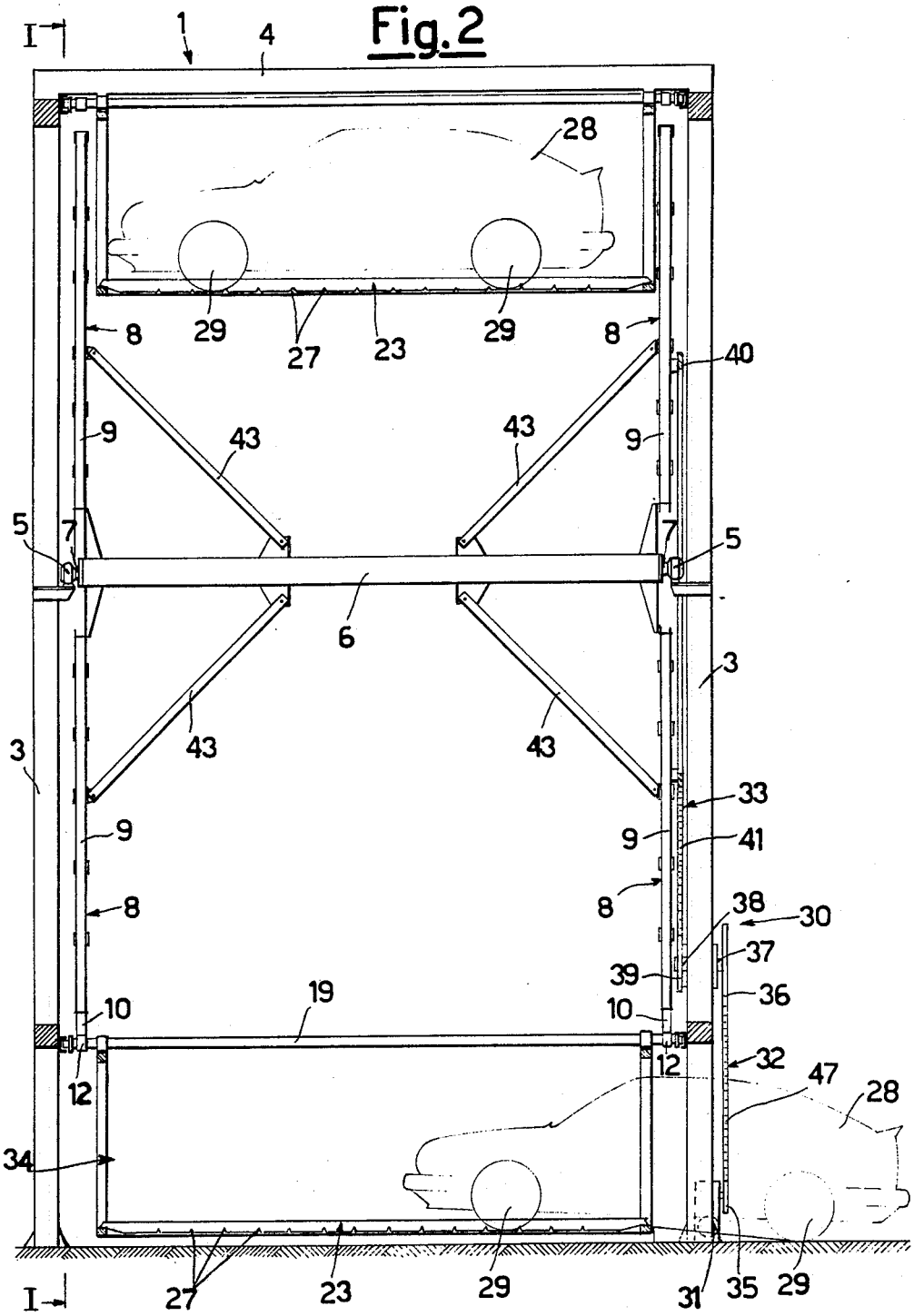
FIG. 2 is a sectional view of the multi-level carpark according to line II—II of FIG. 1.
Figure 3:
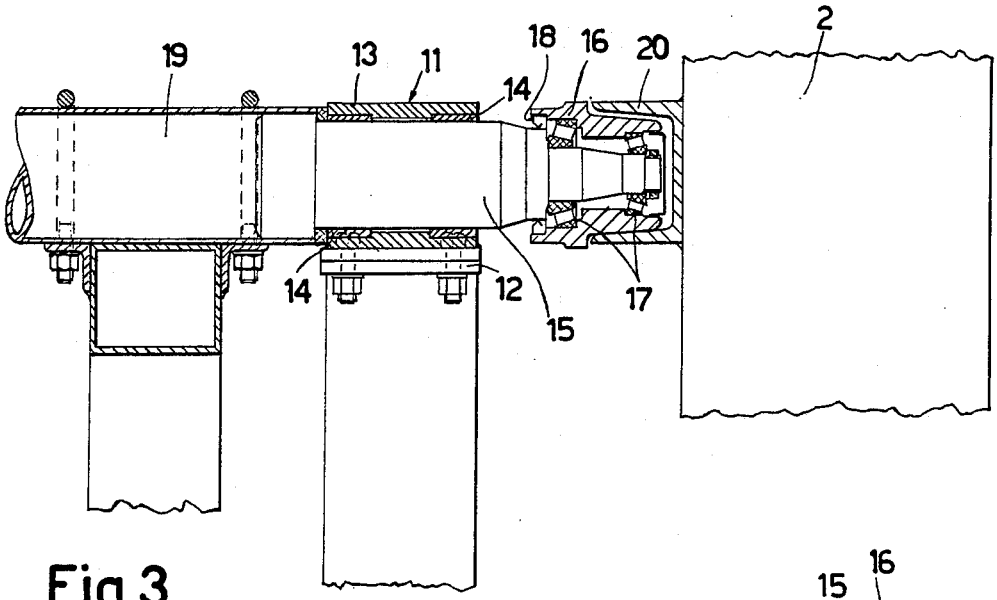
FIG. 3 is a detail view of some kinematic components.
Figure 4:
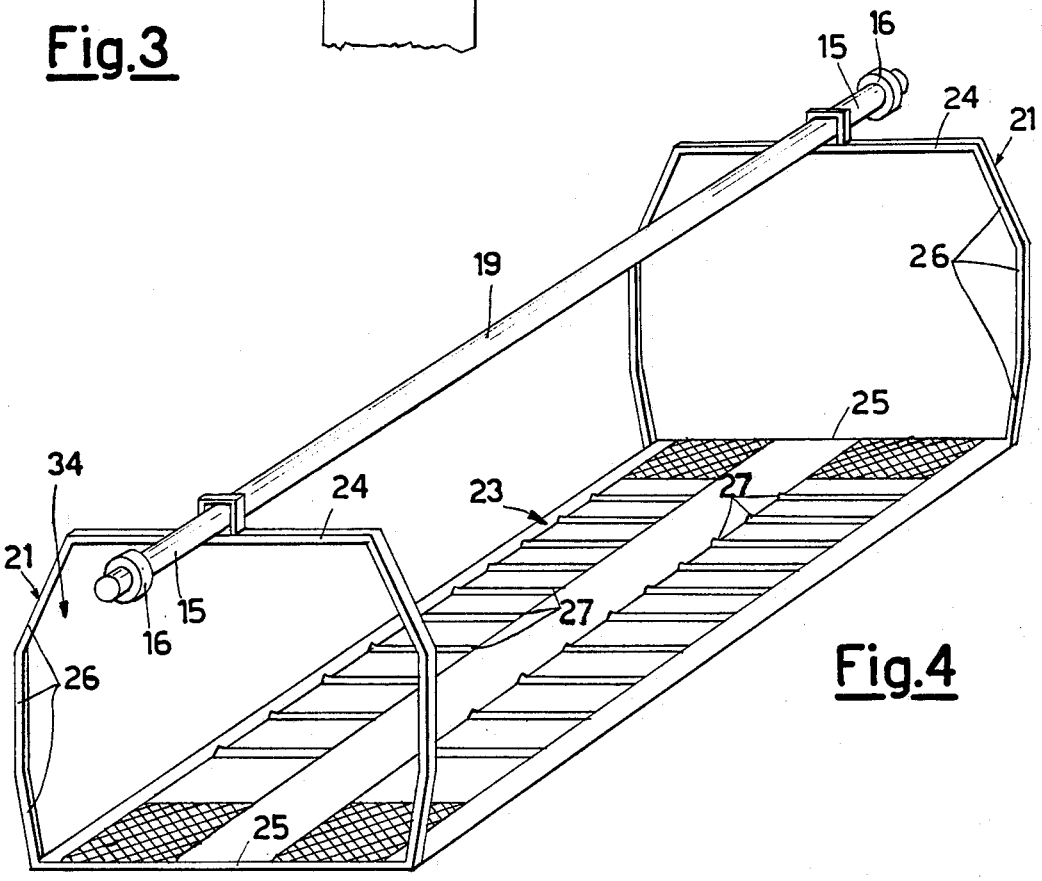
FIG. 4 is a perspective view of one of the means used for garaging the vehicles.

Referring to FIGS. 1, 2, 3 and 4, the multi-level carpark of the invention, generally indicated by the reference numeral 1, comprises a gantry structure 2, integral with the ground, and consisting of uprights 3, i.e., two central uprights and side uprights, connected by connection crossbeams 4, and defining, in its interior, the useful volume of the multi-level carpark. Each one of the two central uprights 3 supports, in its middle, a bearing 5 engaged by the two ends 7 of a shaft 6, which is a part of a carrousel structure, which is hereunder disclosed.

In correspondence with the two ends 7 of the shaft 6, two sets of telescopic arms 8 extend radially in a sunburst configuration, said telescopic arms 8 being constituted by a first fixed element 9, and by a second, retractable, element 10, sliding inside said first fixed element 9 by means of guide and support means 45.

The telescopic arms 8 are braced, relatively to the shaft 6, by means of first rods 43 hinged at their ends, and are braced relatively to each other, by means of second rods 44.

At the end of each retractable element 10, a support 12 is provided, to which a bushing, generally indicated by the reference numeral 11, is constrained.

Each bushing 11 comprises an outer shell 13 inside which two half-bearings 14 are placed, which cooperate with the hubs 15 welded to the two ends of each support shaft 19. The free ends of the hubs 15 are provided with an idle roller 16 supported by a couple of bearings 17 protected from the entry of foreign matter by a sealing gasket 18. Each idle roller 16 slides inside one of the two guides 20, having a "U" shaped cross-section, welded to the uprights 3 and to the crossbeams 4 of the gantry structure 2.

The guides 20 form a closed route, having the shape of a rounded-corner square. Each shaft 19 supports vehicle garaging means, or cells, generally indicated by the reference numeral 34, and, in particular, by the letters A through N.

Such means comprise a couple of tilting brackets 21 rigidly constrained in correspondence of the ends of a same support shaft 19 and connected with each other by a couple of gangways 23 placed at a distance from each other corresponding to the track of the vehicles to be garaged.

Each bracket 21 has an octagonal outline, and comprises a top element 24 connected with a base element 25 by means of intermediate elements 26 all positioned according to a broken polygonal line, securing the maximum exploitation of the available room with no danger of impacts between the various cells 34 during the movement of the multi-level carpark, as it can be better understood from the hereunder operation disclosure. The gangways 23 provided between the two base elements 25 constitute the running track for the wheels 29 of a car 28.

The running of such wheels is made easier by antislip ribs 27, which also act as strengthening elements for the gangways 23.

In an alternative form of practical embodiment, not illustrated for the sake of simpleness, the cells 34 are provided with a completely closed structure, in order to better protect the vehicle from the inclemency of the weather, and provided with a pair of roll-up shutters on the two opposite sides of the cell.

The elements 5 through 20 constituted, in their whole, a horizontal-axis carrousel structure, supported by the gantry structure 2 and driven by a drive unit 30, and associated to means for vehicle garaging 34.

The drive unit 30 comprises a ratiomotor 31 acting on two chain drives, respectively a primary chain drive 32 and a secondary chain drive 33. The primary chain drive 32 comprises a couple of sprocket wheels 35 and 36 connected by a chain 47, and respectively keyed on an end of the ratiomotor shaft 31 and on the first end of a shaft 37 of a return support 38. The secondary chain drive 33 comprises a couple of sprocket wheels 39 and 40 connected by a chain 41, respectively keyed on the second end of the shaft 37 and on one of the two sets of telescopic arms 8 which radially extend in a sunburst configuration from one of the two ends of the shaft 6.

In case of a breakdown, or of lack of electrical energy, the unit 30 is provided with means (not shown in the Figures) enabling it to be manually operated by means of a crank.

The multi-level carpark 1 is completed by a fence 42 provided at the base of the multi-level carpark, in order to prevent ill-intentioned persons from freely accessing the multi-level carpark, and, in particular, the cars parked inside the cells 34 which are at ground level.

The other cars are, on the contrary, sufficiently protected by the structure of the multi-level carpark, because the related cells are placed at such a height from ground, and in such a position as to discourage attempts of theft and/or damaging.

Figure 5:
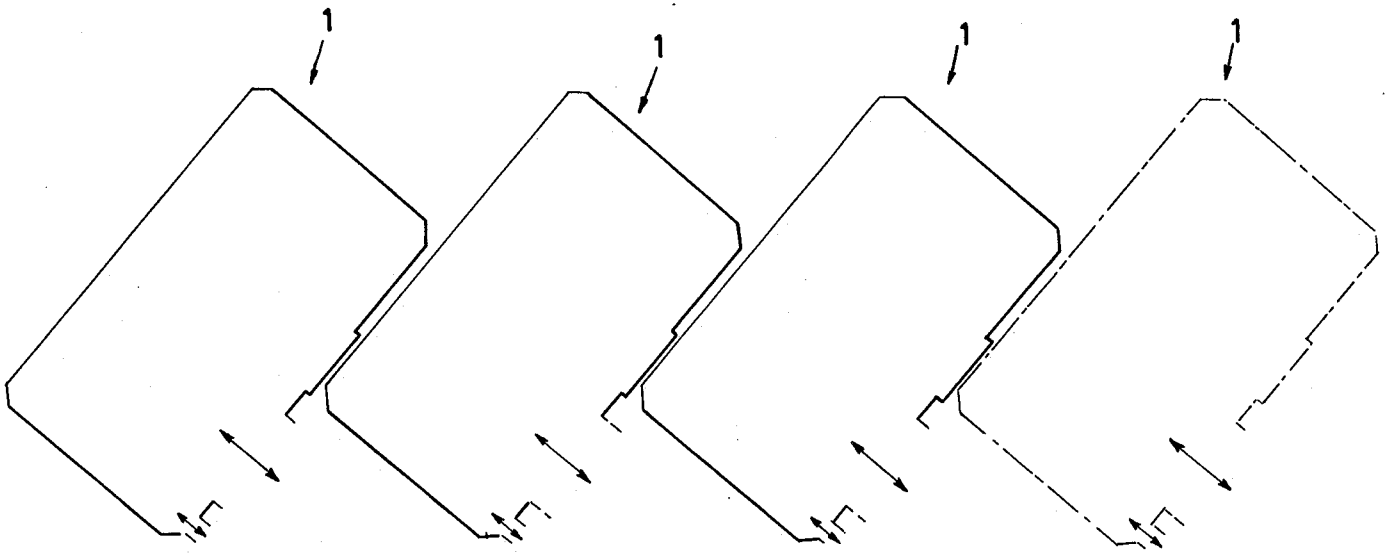
FIG. 5 is a sketch showing one from the many possible advantageous layouts of a plurality of multi-level carparks grouped to form one single, large-capacity multi-level carpark.

Referring in particular to FIG. 5, it is possible to associate a plurality of multi-level carparks 1, so grouped as to obtain one single large-capacity multi-level carpark, provided with a plurality of points wherein the contemporaneous loading and/or unloading of the cars is possible.

Referring, in particular, to FIG. 1, the cells marked by the letters A and C are in position of loading, or unloading, of the relevant vehicles. When said operations are completed, the clockwise, or counterclockwise, revolution, arrow F (according to which of the two revolution directions is the most suitable) of the carrousel structure brings to the ground level the remaining cells the user is interested in.

The rationalization of such operations can be carried out by means of a suitable electronic equipment.

The particular shape of the route defined by the "U"-shaped guides 20, and of the polygonal outline of the cross-section of the cells 34 prevents said cells 34 from colliding, during the movement of the carrousel structure they belong to, even if their number is larger that the number which could be housed by a carrousel structure having the same overall dimensions, but with a simply circular outline.

From the above disclosure, further benefits are evident, besides those already mentioned, which the users of such a multi-level carpark can get. The operations of garaging and recovery of the cars can be further accelerated by changing the length of the side of the guides 20 which is close to ground, so to house a larger number of cells 34 in vehicle loading or unloading position.

In as much as such cells can be furthermore so constructed, as to allow the vehicle to enter and to leave them through the opposite walls, they further accelerate the related operations, because in such a way it is possible to avoid to carry out troublesome reverse-motion manoeuvres, and the multi-level carpark results easier accessible, in as much as entrances and exits can be provided on opposite sides.

The multi-level carpark of the instant invention can be designed with no need for complying with any special safety regulations, forasmuch as it is not intended to house any people inside its structures, besides allowing also cars fueled with gas fuels to be garaged, whilst such cars are forbidden, owing to safety reasons, to enter the traditional multi-storey carparks having a closed structure.

According to an alternative form of practical embodiment, the closed route of the "U"-guides 20 could be given the shape of a regular polygon, or a parallelogram shape, e.g., the shape of a rectangle having its longer sides arranged in the vertical direction.

This latter form of practical embodiment is particularly suitable for giving the multi-level carpark a larger capacity, without increasing the dimensions thereof in its points close to ground.

I claim:

1. An automobile parking structure comprising:

a support structure including a continuous track; and a carousel structure including a center axle rotatably supported by said support structure, a plurality of telescopable arms extending radially from said center axle and a plurality of automobile platform assemblies;

said telescopable arms having first and second ends, said first ends being attached to said center axle, said second ends slidably engaging said track;

said automobile platform assemblies being rotatably attached to said second ends of said telescopable arms whereby the telescopability of said arms permits said second ends to follow the contour of said track.

2. An automobile parking structure according to claim 1 wherein said support structure is a gantry with said carousel structure received within.

3. An automobile parking structure according to claim 2 wherein said support structure includes two spaced tracks, said tracks being oriented vertically and being of the same size and shape;

said carousel structure includes two identical sets of said telescopable arms, said sets of arms located substantially at the ends of said center axle.

4. An automobile parking structure according to claim 3 wherein said tracks have a horizontal portion parallel to the ground greater in length than the width of two of said automobile platform assemblies.

5. An automobile parking structure according to claim 3 wherein said tracks are in the shape of a round-cornered parallelogram.

6. An automobile parking structure according to claim 5 wherein said parallelogram is a square.

7. An automobile parking structure according to claim 3 wherein said tracks are channel-shaped in cross-section;

said second ends of said telescopable arms and in idle rollers received in said tracks.

8. An automobile parking structure according to claim 1 wherein said automobile platform assemblies include a support rod, two end frame assemblies and an automobile platform;

said support rod extends between and is rotatably attached approximate its ends to a pair of said telescopable arms;

said end frame assemblies is supported by said support rod approximate the ends of said support rod;

said automobile platform extends between and is supported by said end frames.

9. An automobile parking structure according to claim 8 wherein said end frames have a top cross bar, two side bars and a bottom bar connected on ends to form a closed frame:

said side bars are in the shape of a polygonal broken line.

10. An automobile parking structure according to claim 9 wherein said end frames are designed such that automobiles can be driven through said end frames.

11. An automobile parking structure according to claim 10 wherein said side bars extend (1) outwardly and downwardly from said top cross bar at an angle to said top cross bar and (2) outwardly and upwardly from said bottom bar at an angle to said bottom bar.

12. An automobile parking structure according to claim 8 wherein said end frames are in the shape of a polygon.

13. An automobile parking structure according to claim 12 wherein said polygon has shoulders which slope outwardly and downwardly from a top surface thereof.

14. An automobile parking structure according to claim 8 wherein said automobile platform includes antislip ribs.

15. An automobile parking structure according to claim 1 further comprising means for rotating said carousel structure relative said support structure.

16. An automobile parking structure according to claim 15 wherein said rotating means comprises a ratiomotor, a primary chain drive, a return support and a secondary chain drive;

said ratiometer drives said primary chain drive, said primary chain drive drives said secondary chain drive via said return support, and said secondary chain drive drives said carousel structure.

17. An automobile parking structure comprising:

a gantry support structure including two continuous tracks, said tracks being of the same size and shape; and a carousel structure housed within said gantry support structure and including a center axle rotatably supported by said gantry support structure, two sets of telescopable arms and a plurality of automobile platform assemblies;

said telescopable arms having first and second ends, said first ends being attached to said center axle, said second ends slidably engaging said tracks;

one of said sets of telescopable arms being located approximate each end of said center axle, said telescopable arms being arranged in pairs comprising one of said arms from each of said sets;

one of said automobile platform assemblies being rotatably attached to each said pair of said telescopable arms whereby the telescopability of said arms permits said second ends to follow the contour of said track.

18. An automobile structure according to claim 17 wherein said tracks are oriented vertically and have a cross section in the shape of a channel;

said ends of said telescopable arms are received in the channel.

19. An automobile parking structure according to claim 17 wherein said automobile platform assemblies include a support rod, two end frame assemblies and an automobile platform;

said support rod extending between and being rotatably attached approximate its ends to one of said pairs of telescopable arms;

said end frame assemblies being supported by said support rod approximate the ends of said support rod;

said automobile platform extending between and being supported by said end frames.

20. An automobile parking structure according to claim 19 wherein said end frames are in the shape of a polygon and have shoulders which slope outwardly and downwardly from a top surface of the polygon.

* * * * *